US007818936B2

(12) United States Patent
Morin et al.

(10) Patent No.: US 7,818,936 B2
(45) **Date of Patent: *Oct. 26, 2010**

(54) EXTRUDED PERMANENT FORM-WORK FOR CONCRETE

(75) Inventors: Cecil Morin, Warburg (CA); Clifford Rondin, Edmonton (CA); Brian Reimer, Calgary (CA); Stanley Lachmansingh, Colorado Springs, CO (US)

(73) Assignee: Octaform Systems Inc., Vancouver, British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/288,104

(22) Filed: Oct. 15, 2008
(Under 37 CFR 1.47)

(65) Prior Publication Data

US 2009/0139171 A1 Jun. 4, 2009

Related U.S. Application Data

(63) Continuation of application No. 10/097,644, filed on Mar. 15, 2002, now Pat. No. 7,444,788.

(51) Int. Cl.
*E04B 2/00* (2006.01)

(52) U.S. Cl. ..... 52/426; 52/421; 52/425

(58) Field of Classification Search ..... 52/421, 52/425, 426, 439

See application file for complete search history.

(56) References Cited

U.S. PATENT DOCUMENTS

| | | | |
|---|---|---|---|
| 4,180,956 | A | 1/1980 | Gross |
| 5,216,863 | A | 6/1993 | Nessa et al. |
| 5,311,718 | A | 5/1994 | Trousilek |
| 5,465,545 | A | 11/1995 | Trousilek |
| 5,491,947 | A | 2/1996 | Kim |
| 5,608,999 | A | 3/1997 | McNamara |
| 5,625,989 | A | 5/1997 | Brubaker et al. |
| 5,729,944 | A | 3/1998 | De Zen |
| 5,740,648 | A | 4/1998 | Piccone |
| 5,860,262 | A | 1/1999 | Johnson |
| 5,953,880 | A | 9/1999 | De Zen |
| 6,167,669 | B1 | 1/2001 | Lanc |

(Continued)

FOREIGN PATENT DOCUMENTS

| | | |
|---|---|---|
| CA | 957816 | 11/1974 |

(Continued)

*Primary Examiner*—Basil Katcheves
(74) *Attorney, Agent, or Firm*—Chernoff, Vilhauer, McClung & Stenzel

(57) ABSTRACT

A set of extruded panels is provided for constructing a form-work for concrete. The set includes a plurality of first, second and connecting wall panels. The first wall panels are arranged edge to edge to form a first wall. The second wall panels are arranged edge to edge to form a second wall generally parallel to the first wall. The connecting wall panels are arranged to span transversely between the first and second walls. Each first wall panel incorporates an outer wall extending between first and second edges of the first wall panel, and an inner wall extending between first and second edges of the first wall panel, the inner wall spaced transversely from the outer wall and located relatively more proximate to the second wall panel. Each first wall panel incorporates a plurality of support walls extending transversely between the outer and inner walls.

24 Claims, 4 Drawing Sheets

U.S. PATENT DOCUMENTS

| | | | |
|---|---|---|---|
| 6,189,269 | B1 | 2/2001 | De Zen |
| 6,212,845 | B1 | 4/2001 | De Zen |
| 6,219,984 | B1 | 4/2001 | Piccone |
| 6,247,280 | B1 | 6/2001 | Grinshpun et al. |
| 6,435,471 | B1 | 8/2002 | Piccone |
| 6,622,452 | B2 | 9/2003 | Alvaro |
| 6,694,692 | B2 | 2/2004 | Piccone |
| 6,935,081 | B2 | 8/2005 | Dunn et al. |
| 2004/0010994 | A1 | 1/2004 | Piccone |
| 2005/0016083 | A1 | 1/2005 | Morin et al. |
| 2005/0016103 | A1 | 1/2005 | Piccone |
| 2006/0213140 | A1 | 9/2006 | Morin et al. |

FOREIGN PATENT DOCUMENTS

| | | |
|---|---|---|
| CA | 2170681 | 8/1997 |
| CA | 2243905 | 5/2002 |
| WO | 9607799 | 3/1996 |
| WO | 0163066 | 8/2001 |
| WO | 03006760 | 1/2003 |

EXTRUDED PERMANENT FORM-WORK FOR CONCRETE

CROSS-REFERENCE TO RELATED APPLICATIONS

This application is a continuation of, and claims the benefit under 35 U.S.C. §120 and 35 U.S.C. §121 to U.S. patent application Ser. No. 10/097,644, filed Mar. 15, 2002, which is incorporated herein by reference.

TECHNICAL FIELD

This invention relates to a set of extruded form-work panels which are interconnected in use to define a form-work for casting of concrete and which are intended to remain in place after the concrete is cured to define inner and outer surfaces of the finished concrete structure.

BACKGROUND OF THE INVENTION

There have been many attempts over the years to generate an alternative form of building construction which utilizes permanent forms into which concrete is poured and cured to provide the structural strength for the exterior form work. The use of plastic extruded panels for the formwork has previously been proposed and these can be readily assembled on sight to provide a structure into which reinforcing bars can be inserted and into which the concrete can be inserted and into which the concrete can be poured. The plastic panels then remain in place forming inside and outside surfaces for the concrete structure thus avoiding the necessity for additional cladding and providing in one step a finished attractive appearance.

One example and arrangement of this type is shown in Canadian Patent 957,816 (Rodighiero et al) issued Nov. 19, 1974 which discloses inside wall panels and outside wall panels which are connected edge to edge so as to form inside and outside walls respectively. The panels are connected edge to edge and supported in their spaced position by transverse connecting walls. Embodiments are disclosed in which an insulation material can be applied between the concrete and one of the side walls. The side wall which supports the concrete is prevented from bowing primarily by transversely extending stiffening ribs. However additional wall portions can be provided connected to the side wall and extending generally at right angles thereto so as to hold the side wall against bowing outwardly under the weight of the concrete.

A further arrangement which has achieved some commercial success is shown in U.S. Pat. No. 5,216,863 (Nessa et al) issued Jun. 8, 1993. This discloses a generally cylindrical structure with one open face where the cylindrical elements slide each into the next using male and female couplings to form a similar permanent form work structure to develop the above patent but in which the structure takes the form of a series of interconnected columns.

Canadian Patents 2,215,939, 2,218,600 and 2,226,497 of Piccone disclose various constructions of form work of a similar nature to that shown in the above patent of Rodighiero but many shaped to form the column structure similar to that of Nessa.

It has been determined recently that the most commercial structure for arrangements of this type is one in which the inside and outside walls are generally flat and of course the materials are kept substantially to a minimum so as to reduce the construction cost of the initial formwork. It is of course important also to minimize the labour involved in assembly of the structures on site.

One problem which arises in meeting the above criteria is to ensure that the structure is stable and prevents the bowing of the side wall which is contact with the concrete.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

Three alternative embodiments of the invention will now be described in conjunction with the accompanying drawings in which.

DETAILED DESCRIPTION OF PREFERRED EMBODIMENT

Figure 1:
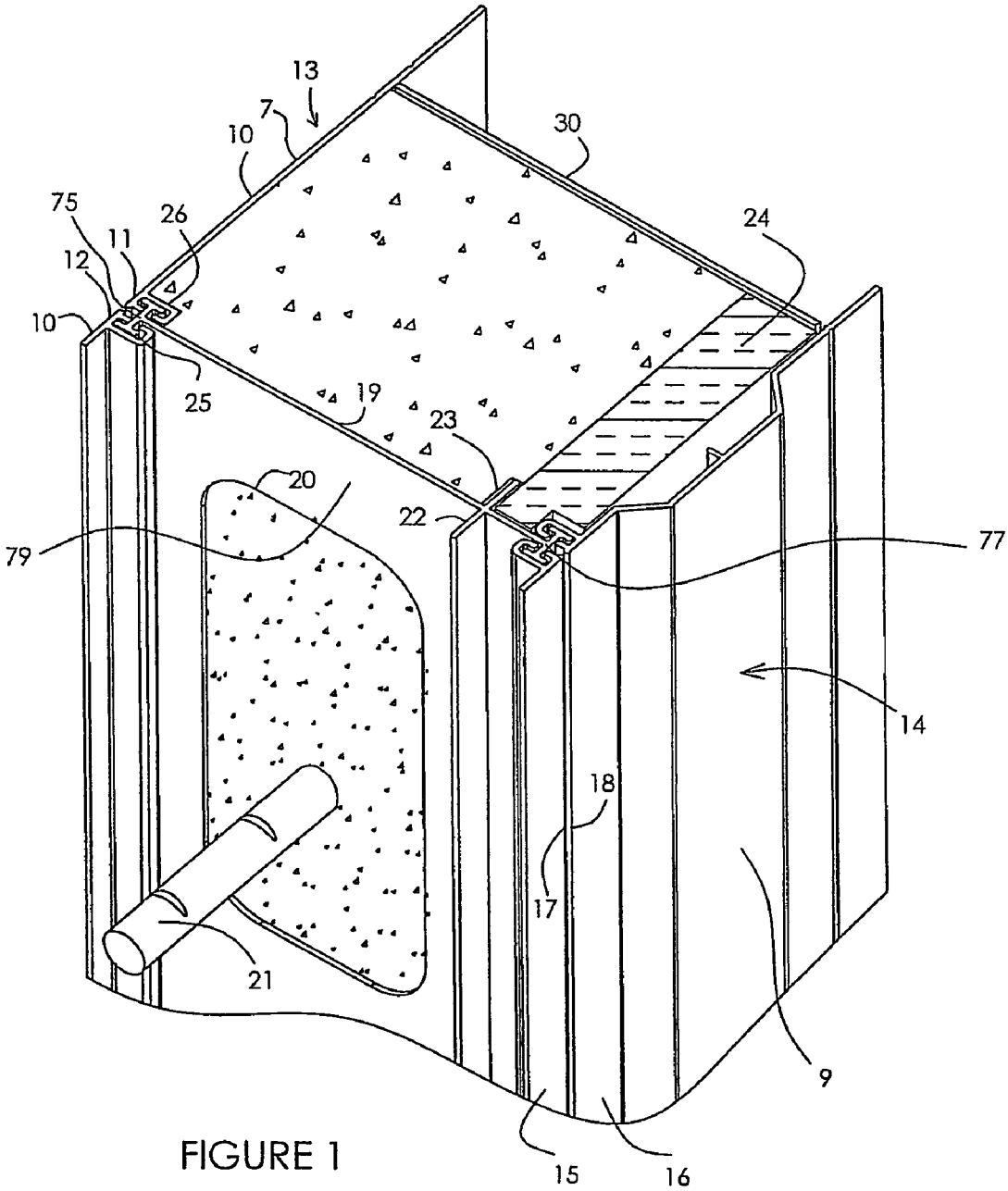
FIG. 1 is an isometric view showing in general a form-work for casting of concrete.

In FIG. 1 is shown a formwork of the general type shown in the above Canadian patent of Rodighiero and as modified by the inclusion of support apparatus 30 (shown schematically in FIG. 1) according to a particular embodiment of the invention. The FIG. 1 construction includes a plurality of inside wall panels 10 which stand vertically upwardly to provide intermediate side wall portions 7 between side edges 11 and 12. Inside wall panels 10 are connected at side edges 11 and 12 to form an inside wall structure 13. A similar outside wall structure 14 includes outside wall panels 15 and 16 which comprise intermediate side wall portions 9 and which are connected together at side edges 17 and 18. Inside wall structure 13 and outside wall structure 14 may be referred to as first and second or inner and outer "side walls" 13, 14. Inside wall panels 10 and outside wall panels 15, 16 may be referred to as first and second "side wall panels" 10, 15, 16.

Inside wall structure 13 and outside wall structure 14 are interconnected by connecting wall panels 19 which bridge the space between side walls 13, 14 and also act to connect together first side wall panels 10 at their side edges 11, 12 and second side wall panels 15, 16 at their side edges 17, 18. Connecting wall panels 19 comprise intermediate connecting wall portions 79 which extend between first and second side edges 75, 77 of connecting wall panels 19. Intermediate connecting wall portions 79 of connecting wall panels 19 include holes 20 which allow concrete poured into the individual cells defined between connecting wall panels 19 to pass between the cells and thus form an integral concrete structure throughout the formwork defined between side walls 13, 14. Prior to pouring the concrete, suitable reinforcing bars 21 can be inserted through aligned holes 20 in connecting wall panels 19.

All of the panels are formed by extrusion so that they have a constant cross section and details of the panels are shown and described in FIGS. 2, 3 and 4 as set out hereinafter.

Connecting wall panels 19 have a pair of right angled tongues 22 and 23 projecting outwardly from the sides thereof parallel to outer side wall 14 and closer to outer side wall 14. Tongues 22, 23 thus define a channel for receiving a portion 24 of rigid foamed insulation material which is cut to the required shape and inserted into the cell adjacent outer side wall 14 and outside tongues 22 and 23. The concrete is thus restricted to the area between foam insulation material 24 and inner side wall 13.

Connecting wall panels 19 include, at each of first and second side edges 75, 77, a pair of male connectors 25 for insertion into female receptacles 26 at the edges 11 and 12 of inside wall panels 10 and at the edges 17 and 18 of outside wall panels 15, 16.

In between edges 11, 12, it is necessary to provide support for inside wall panels 10 to prevent their bowing inwardly into the building under the weight of the concrete prior to its curing. Thus, inside wall panels 10 are supported by support walls 30 shown schematically in FIG. 1 and shown in further detail and in different alternatives in FIGS. 2, 3 and 4.

Figure 2:
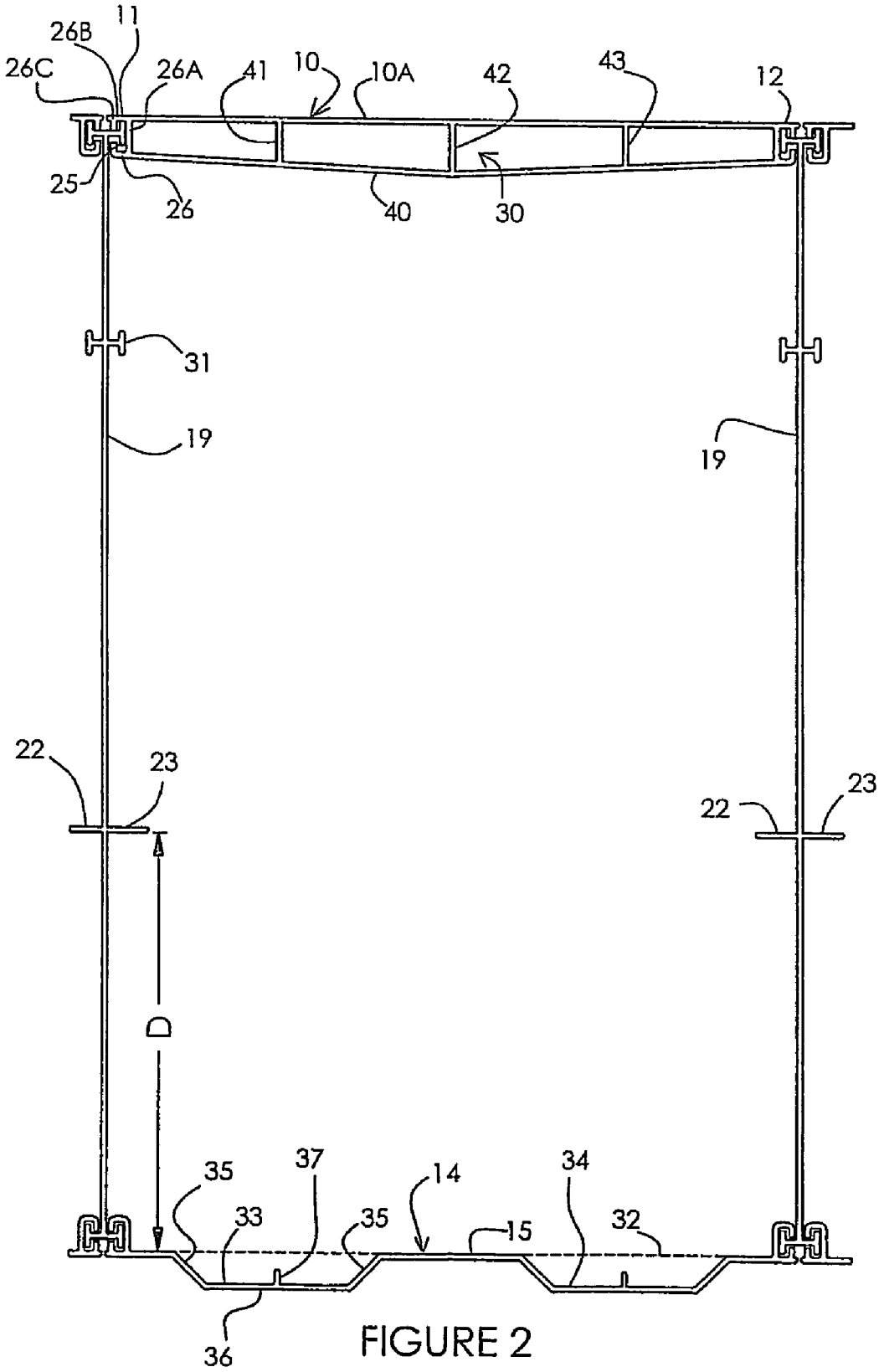
FIG. 2 is a horizontal cross sectional view of a first embodiment of the panels according to the present invention to provide a form-work of the general construction shown in FIG. 1.

Turning firstly to FIG. 2, it will be noted that the male connectors 25 on connecting wall panels 19 are generally T-shaped with a leg of the T connected to each connecting wall panel 19 at its edge and the top of the T generally parallel to connecting wall panel 19.

It will be further noted that female receptacles 26 are generally C-shaped so as to wrap around the top of T-shaped connectors 25. Thus the C-shape includes a base 26A parallel to the top of the T bar and two legs which wrap around the T bar and extend toward the leg of the T bar. Thus the ends of the legs on the inside surface of the T bar lies adjacent or in contact with the respective side surface of connecting wall panel 19. The other leg of the C-shape as indicated at 26B is provided on the exposed surface of inside wall panel 10 and forms a portion or edge 26C which abuts with the corresponding edge of the next adjacent inside wall panel 10 so that connecting wall panel 19 is not itself visible from the outside of the structure. Thus, the interconnections between inside wall panels 10 are in the form of a single vertical line providing an attractive appearance.

The interconnection with outer side wall 14 is identical and is again formed by the T-shaped male members on connecting wall panel 19 and female C shaped receptacles on outside wall panels 15, 16.

Right angled tongues 22 and 23 are visible in FIG. 2 and are spaced from outer side wall 14 by a distance D which is substantially equal to the thickness of the foam insert of insulation material.

An additional T-shaped male member 31 is provided on connecting wall panel 19 at a position adjacent to inside wall panel 10. This is not used in the construction of FIG. 2 but is provided as an alternative mounting arrangement to allow flexibility in the construction to accommodate different structural arrangements and particularly the arrangement shown in FIG. 3 which may be adopted in some circumstances.

Outside wall panels 15, 16 are shaped so as to define a generally flat plane 32 forming a flat outside wall structure 14. However in order to provide an attractive appearance and in order to accommodate expansion and contraction which will occur due to significant temperature changes at the outside surface, outside wall panels 15, 16 include ribs 33 and 34, each of which is defined by an inclined side wall 35, an outer panel portion 36 parallel to plane 32 and a second inclined side wall 35. This arrangement allows the expansion which will occur to be taken up in slight changes in angle in the inclined side walls 35. A projecting flange 37 is provided on the inside of ribs 33, 34. From the aesthetics point of view, therefore, ribs 33, 34 break up the appearance of the flat surface so that any imperfections in what would otherwise be a totally flat surface are not immediately apparent to the eye. Slight changes in angle or surface shape are therefore not visible due to the presence of ribs 33, 34 and the changes of shading which occur due to light patterns formed by those ribs. However the centre section between ribs 33, 34 lies in a common plane 32 and therefore side wall 14 is basically flat.

In the embodiment of FIG. 2, inside wall panel 10 supports the concrete within the cell and is prevented from bowing by the construction generally indicated at 30. In the embodiment of FIG. 2 the arrangement 30 which prevents the bowing is defined by an additional inside wall 40 and three transverse support walls 41, 42 and 43. Inside wall 40 is equal in width to side wall panel 10 and forms a contiguous extension of the inside leg of C-shaped receptacle 26.

The outer wall 10A of side wall panel 10 is integrally extruded with C-shaped receptacles 26, inner wall 40 and transverse support walls 41, 42 and 43 to form an integral closed structure defining four hollow interior cells between transverse support walls 41, 42, 43. Inner wall 40 is fully closed so that concrete is prevented from entering into the hollow interior cells. The width of transverse support wall 42 is slightly greater than that of transverse support walls 41 and 43 and also slightly greater than that of the cross bar 26A of C-shaped receptacle 26, so that inside wall 40 is slightly V-shaped reaching an apex at transverse support wall 42.

The double wall integral structure thus formed as a simple single extrusion of the embodiment of FIG. 2 thus supports the concrete and prevents bowing of inside wall panel 10. The hollow cells can also provide a space for receiving utilities such as wiring and the like.

Figure 3:
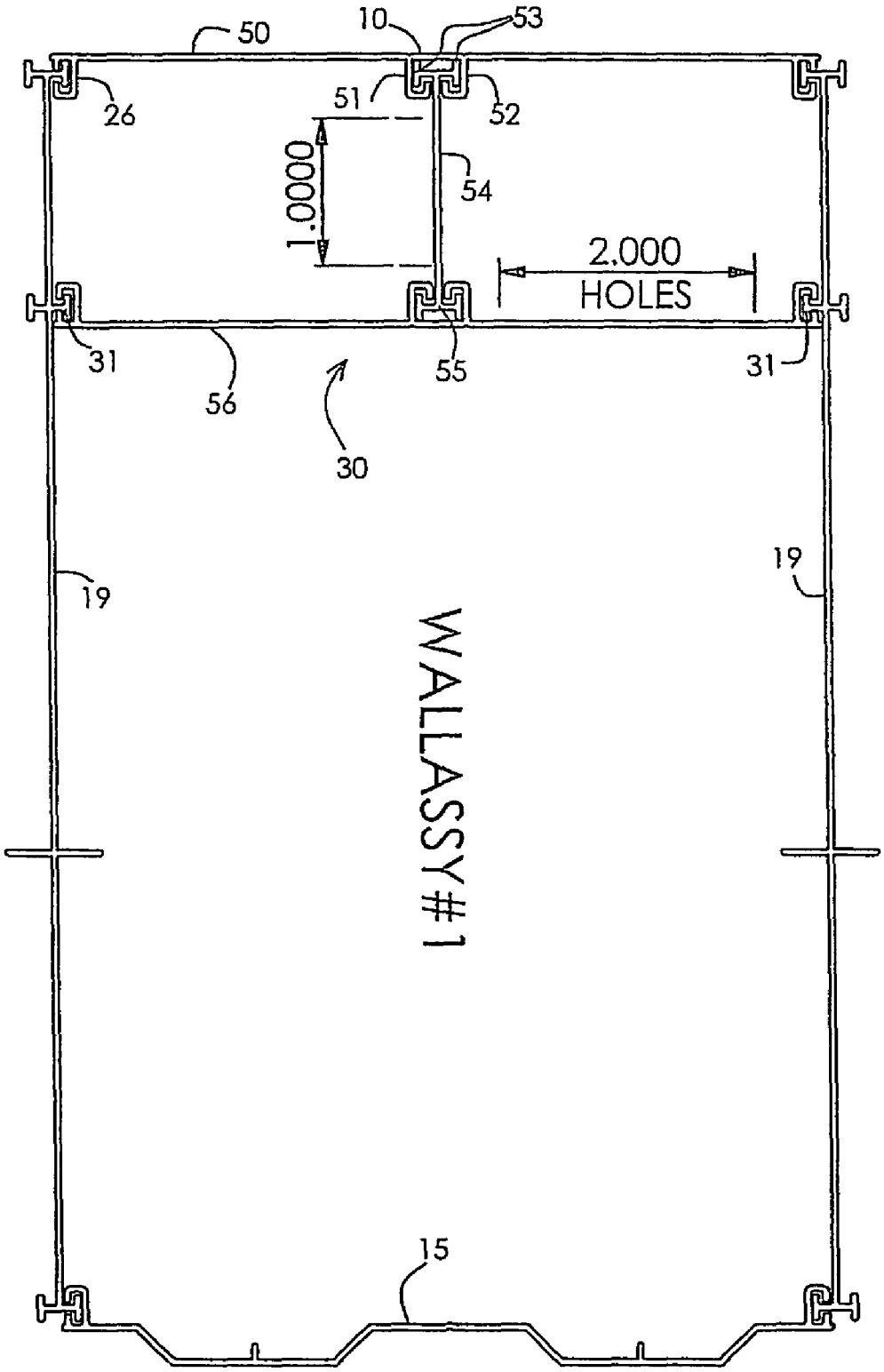
FIG. 3 is a horizontal cross sectional view of a second embodiment of the panels according to the present invention to provide a form-work of the general construction shown in FIG. 1.

Turning now to FIG. 3, there is shown an alternative construction which uses the same connecting wall panels 19 and the same outside wall panels 15, 16 as that of FIG. 2.

In this embodiment, inside wall panel 10 includes the same C-shaped receptacles 26 but is formed only from a single sheet of plastic material as indicated at 50. In this embodiment the single wall panel 50 includes two female receptacles 51 and 52 on its inside surface with the C-shaped receptacles facing each other and spaced so as to receive the T-shaped male members 53 of a supporting wall portion 54. Thus the C-shaped receptacles 51 and 52 include, as one side of the C-shape, single wall panel 50 itself and extend from the panel at right angles to the panel a leg which wraps around the T bar top of T-shaped male members 53.

Supporting wall portion 54 thus is supported by female receptacles 51 and 52 and projects generally at right angles to single wall panel 50 to an opposed end 55 spaced from single wall panel 50.

An additional wall panel 56 which is identical in cross section to inside wall panel 10 is attached to the end 55 of supporting wall portion 54 and to T-shaped members 31 on connecting wall panels 19. Additional wall panel 56 is thus parallel to single wall panel 50 and spaced therefrom across the hollow interior of the cell. Both supporting wall portion 54 and additional wall panel 56 have holes which allow the concrete to pass through those holes from the interior of the cell to enter and fill the rectangular areas between the single wall panel 50 and additional wall panel 56. Thus the whole of the structure is filled with concrete up to single wall panel 50 and additional wall panel 56 and support wall portion 54 are present merely to provide support for single wall panel 50 during installation.

Figure 4:
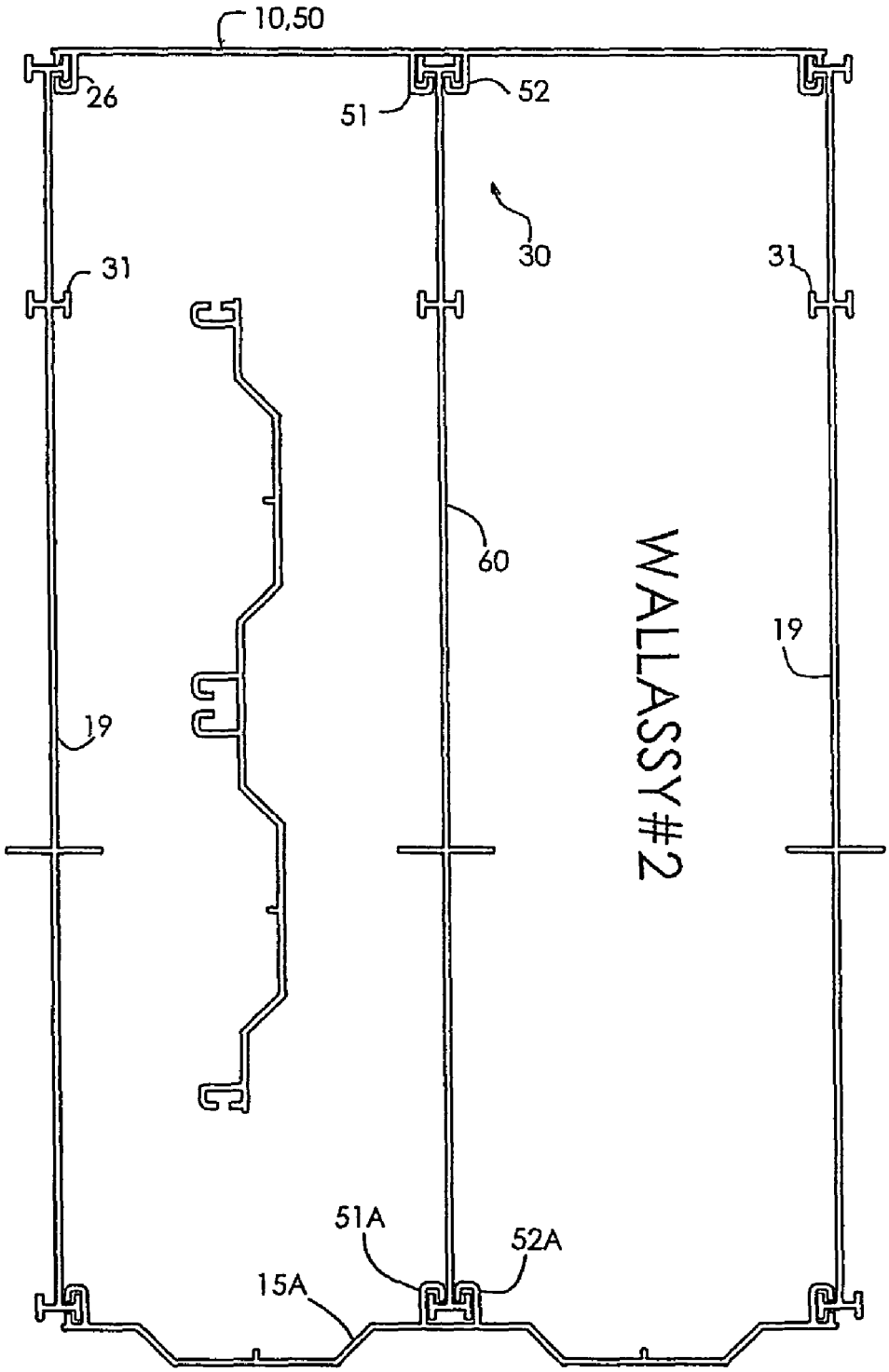
FIG. 4 is a horizontal cross sectional view of a third embodiment of the panels according to the present invention to provide a form-work of the general construction shown in FIG. 1.

Turning now to FIG. 4, there is shown a further alternative arrangement which uses the same inside wall panel 10 (i.e. single wall panel 50) and connecting wall panels 19 as those shown in FIG. 3. Thus, single wall panel 50 is connected using receptacles 26 to the male connectors at the edge of connecting wall panel 19.

In this embodiment, support 30 is provided by an additional support wall 60 which is identical in cross section to connecting wall panels 19 and extends across the full width of the cell from single wall panel 50 of inside wall panel 10 to outside wall panel 15A. Outside wall panel 15A is modified relative to outside wall panel 15 of the previous embodiment by the addition of C-shaped receptacles 51A and 52A identical in construction to the receptacles 51 and 52 on single wall panel 50. Thus, the T-shaped male connectors on the edge of additional support wall 60 are engaged into receptacles 51A and 52A and at the same time the male connectors on the other edge of additional support wall 60 are engaged into receptacles 51 and 52. Thus, additional support wall 60 bridges the whole width of the cell and communicates bowing forces on single wall panel 50 across the width of the structure to outside wall panel 15A.

In this embodiment, the construction is simplified by the fact that additional support wall 60 is identical in cross section to connecting wall panels 19, thus reducing manufacturing cost and inventory problems.

The arrangements described above therefore provide an effective support for the inside wall panel to prevent its bowing while allowing use of simple forms and reducing manufacturing costs by use of the same cross sectional elements at different locations in the structure.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

The invention claimed is:

1. A set of panels for use in constructing a form-work for concrete, comprising:

a plurality of first, second and connecting wall panels extruded longitudinally to define a constant cross section along a length of each panel, the panels each having opposed first and second longitudinal edges;

the first wall panels arranged to be connected edge to edge to form a first wall;

the second wall panels arranged to be connected edge to edge to form a second wall generally parallel to the first wall;

the connecting wall panels arranged to span transversely between the first and second walls with a first edge of each connecting wall panel having a first connector for connection to adjacent edges of an adjacent pair of first wall panels and with a second edge of each connecting wall panel having a second connector for connection to adjacent edges of an adjacent pair of second wall panels, the connecting wall panels holding the first and second walls apart and defining a cell between each adjacent pair of connecting wall panels;

each connecting wall panel having at least one hole for communication of concrete between adjacent cells; and each first wall panel comprising: an outer wall that extends between the first and second edges of the first wall panel; and an inner wall that extends between the first and second edges of the first wall panel, the inner wall spaced transversely from the outer wall and located relatively more proximate to the second wall panel, wherein one of the inner and outer walls has a generally convex cross section along a length of the first wall panel which protects transversely away from the other one of the inner and outer walls.

2. A set of panels according to claim 1 wherein each first wall panel comprises a plurality of support walls extending transversely between the outer and inner walls.

3. A set of panels according to claim 2 wherein, for each first wall panel, the outer wall, inner wall and support walls are integrally formed.

4. A set of panels according to claim 3 wherein, for each first wall panel, the inner wall is contiguous for preventing entry of concrete between the inner and outer walls.

5. A set of panels according to claim 4 wherein, for each first wall panel, the outer wall is substantially planar and the inner wall has a generally V-shaped cross section along a length of the first wall panel with an apex projecting transversely away from the outer wall.

6. A set of panels according to claim 5 wherein, for each first wall panel, the plurality of support walls comprises a primary support wall extending between the outer wall and the apex of the inner wall, and at least one secondary support wall on either side of the primary support wall and spaced apart therefrom.

7. A set of panels according to claim 6 wherein each connecting wall panel has a pair of projecting tongues extending therefrom in opposite directions generally perpendicular to the connecting wall, at a position spaced from the second edge of the connecting wall panel for locating rigid foam insulation between the tongues and the second wall.

8. A set of panels according to claim 6 wherein each second wall panel includes one or more longitudinally extending ribs, each rib defined by a pair of outwardly-projecting longitudinally-extending sides connected by a wall panel portion therebetween.

9. A set of panels according to claim 6 wherein one of:

the first connector of each connecting wall panel; and the adjacent edges of the adjacent pair of first wall panels, comprises a pair of male connectors for insertion into cooperating female receptacles on the other one of:

the first connector of each connecting wall panel; and the adjacent edges of the adjacent pair of first wall panels.

10. A set of panels according to claim 9 wherein the female receptacles are on the adjacent edges of the adjacent pair of first wall panels and are integrally formed with the inner and outer walls of each first wall panel.

11. A set of panels according to claim 10 wherein a portion of the female receptacle forms one of the secondary support walls.

12. A set of panels according to claim 9 wherein one of:

the second connector of each connecting wall panel; and the adjacent edges of the adjacent pair of second wall panels, comprises a pair of male connectors for insertion into cooperating female receptacles on the other one of:

the second connector of each connecting wall panel; and the adjacent edges of the adjacent pair of second wall panels.

13. A set of panels according to claim 12 wherein the second connector of each connecting wall panel comprises a pair of T-shaped members for engagement with cooperating C-shaped members at adjacent edges of the adjacent pair of second wall panels.

14. A set of panels according to claim 9 wherein the first connector of each connecting wall panel comprises a pair of T-shaped members for engagement with cooperating C-shaped members at the adjacent edges of the adjacent pair of first wall panels.

15. A set of panels according to claim 14 wherein the C-shaped members are integrally formed with the inner and outer walls of each first wall panel.

16. A set of panels according to claim 15 wherein a portion of the C-shaped member forms one of the secondary support walls.

17. A set of panels according to claim 2 wherein, for each first wall panel, the plurality of-support walls comprises a primary support wall located at an apex of the generally convex cross section and at least one secondary support wall on either side of the primary support wall and spaced apart therefrom.

18. A set of panels according to claim 17 wherein, for each first wall panel, a transverse dimension of the primary support wall is greater than transverse dimensions of the secondary support walls.

19. A set of panels according to claim 17 wherein, for each first wall panel, a transverse dimension of the primary support wall is greater than transverse dimensions of the secondary support walls.

20. A set of panels for use in constructing a form-work for concrete, comprising:

a plurality of first, second and connecting wall panels extruded longitudinally to define a constant cross section along a length of each panel, the panels each having opposed first and second longitudinal edges;

the first wall panels arranged to be connected edge to edge to form a first wall;

the second wall panels arranged to be connected edge to edge to form a second wall generally parallel to the first wall;

the connecting wall panels arranged to span transversely between the first and second walls with a first edge of each connecting wall panel having a first connector for connection to adjacent edges of an adjacent pair of first wall panels and with a second edge of each connecting wall panel having a second connector for connection to adjacent edges of an adjacent pair of second wall panels, the connecting wall panels holding the first and second walls apart and defining a cell between each adjacent pair of connecting wall panels;

each connecting wall panel having at least one hole for communication of concrete between adjacent cells; and each first wall panel comprising: an outer wall; an inner wall generally parallel to the outer wall, spaced transversely therefrom and located relatively more proximate to the second wall panel, wherein one of the inner and outer walls has a generally convex cross section along a length of the first wall panel which projects transversely away from the other one of the inner and outer walls.

21. A set of panels according to claim 20 wherein each first wall panel comprises a plurality of support walls extending transversely between the outer and inner walls.

22. A set of panels according to claim 21 wherein, for each first wall panel, the outer wall is substantially planar and the inner wall has a generally V-shaped cross section along a length of the first wall panel with an apex projecting transversely away from the outer wall.

23. A set of panels according to claim 22 wherein, for each first wall panel, the plurality of support walls comprises a primary support wall extending between the outer wall and the apex of the inner wall, and at least one secondary support wall on either side of the primary support wall and spaced apart therefrom.

24. A set of panels according to claim 21 wherein, for each first wall panel, the plurality of support walls comprises a primary support wall located at an apex of the generally convex cross section and at least one secondary support wall on either side of the primary support wall and spaced apart therefrom.

* * * * *